US005336319A

United States Patent [19]

Narang et al.

[11] Patent Number: 5,336,319

[45] Date of Patent: Aug. 9, 1994

[54] APPARATUS FOR APPLYING AN ADHESIVE LAYER TO A SUBSTRATE SURFACE

[75] Inventors: Ram S. Narang, Fairport; Stephen F. Pond; Robert P. Altavela, both of Pittsford; Fredrick A. Warner, Fairport; Robert A. Harold, Rochester, all of N.Y.

[73] Assignee: Xerox Corporation, Stamford, Conn.

[21] Appl. No.: 888,220

[22] Filed: May 26, 1992

[51] Int. Cl.[5] ..... B05C 1/02; B05C 11/00; B41L 47/14

[52] U.S. Cl. ..... 118/211; 118/244; 118/257; 118/263; 101/477

[58] Field of Search ..... 118/211, 253, 263, 257, 118/244, 256; 101/415.1, 477; 427/428, 294

[56] References Cited

U.S. PATENT DOCUMENTS

| | | | |
|---|---|---|---|
| 2,659,340 | 11/1953 | Zinn, Jr. | 118/212 |
| 3,408,984 | 11/1968 | Pullins | 118/211 |
| 4,005,653 | 2/1977 | Arkell | 101/415.1 |
| 4,056,057 | 11/1977 | Smith | 101/415.1 |
| 4,209,551 | 6/1980 | Masaki et al. | 118/211 |
| 4,574,020 | 3/1986 | Fosnaught | 118/259 |
| 4,678,529 | 7/1987 | Drake et al. | 156/234 |
| 4,770,909 | 9/1988 | McIntyre | 427/428 |

*Primary Examiner*—W. Gary Jones
*Assistant Examiner*—Steven P. Griffin
*Attorney, Agent, or Firm*—Robert A. Chittum

[57] ABSTRACT

An apparatus for uniformly coating a planar substrate with an adhesive layer has a rotatably mounted sleeve with closed ends to form an internal cavity therein. The sleeve has a plurality of holes therein and its outer surface is covered by a porous layer such as a foam layer. A vacuum is applied to the sleeve cavity, while the sleeve is rotated. One surface of a polymeric film is positioned on the porous layer and held in place by the vacuum acting through the sleeve holes and porous layer. The other surface of the polymeric film contains a uniform adhesive coating. The surface of a planar substrate is tangentially transported past the polymeric film surface with the adhesive layer and in timed registration therewith, so that a nip is formed between the planar substrate and the polymeric film which transfers a uniformly thick portion of adhesive to the planar substrate surface.

10 Claims, 3 Drawing Sheets

APPARATUS FOR APPLYING AN ADHESIVE LAYER TO A SUBSTRATE SURFACE

BACKGROUND OF THE INVENTION

This invention relates to the method and apparatus for applying a uniformly thick adhesive layer to a planar substrate, and more particularly to a method and apparatus for applying a uniformly thick adhesive layer to a surface of an ink jet printhead part, wherein the adhesive layer thickness variation is controlled to a desired tolerance for each of a plurality of identical parts. After subsequent bonding to at least one other printhead part, the adhesive does not flow to undesired regions and obstruct the flow of ink in the assembled printhead, and the fillets of cured adhesive do not vary from printhead to printhead.

U.S. Pat, No. 4,678,529 to Drake et al. discloses a method of bonding ink jet printhead components together by spin coating or spraying a relatively thin, uniform layer of adhesive on a flexible substrate and then manually placing the flexible substrate surface with the adhesive layer against a printhead component surface. A uniform pressure and temperature is applied to ensure adhesive contact with all coplanar surface portions and then the flexible substrate peeled away, leaving a uniformly thin coating on the surfaces to be bonded. A roller or vacuum lamination may be applied to the flexible substrate to insure contact on all of the lands or coplanar surfaces of the printhead part. Unfortunately, this labor intensive method permitted adhesive layer thickness variation between a plurality of identical parts, so that ink flow characteristics varied from printhead to printhead.

U.S. Pat. No. 4,770,909 to McIntyre discloses the use of fluid porous roll applicators for applying coating materials. The coating was performed from room temperature to hot melt coating, including adhesives. The roll applicator is rotatable, hollow, and cylindrical with a microporous surface.

SUMMARY OF THE INVENTION

It is the object of the present invention to control the thickness of an adhesive layer and to control the thickness variation in the adhesive layer applied to a surface of each of a plurality of identical parts, such as, for example the channel plates of a thermal ink jet printhead.

In the present invention, a process and apparatus are used to improve the uniformity of a spin-coated adhesive layer on a disk of polymeric film forming material, such as, for example, Mylar ®. A robotic device automatically places the disk on a conveyor belt with the adhesive covered surface facing up. A rotatably mounted, perforated, cylindrical sleeve with closed ends and a thin porous coating such as polysulfone foam or neoprene layer is rotated at a predetermined speed about its axis. A vacuum is applied to the interior of the sleeve while it is rotated and receives the disk with the adhesive layer one disk at a time. This allows the disk with the adhesive layer facing away from the sleeve to be held to the cylinder for one revolution. At the end of the revolution, the vacuum is shut off and a slight air pressure is then applied to release the used disk from the cylinder, whence it falls into a waste bin placed underneath the cylinder. Means are provided for transporting a planar substrate, such as, for example, a channel wafer containing a plurality of sets of etched channel grooves and an associated through-etched reservoir for each set of channel grooves. The transporting means transports the planar substrates one at a time in timed registration with the disk on the rotating sleeve and tangentially thereto to form a nip therebetween. The transporting means heats the planar substrates to 65°±1° C. and produces a nip pressure of about 5 psi, adjustable by changing the distance between the rotatable cylinder and the platen. In addition the carriage has major and minor keyways or guides which enable each of the planar substrates or etched silicon wafers with flats to be oriented thereon in precisely the same position every time. The disk is larger than the planar substrate and the planar substrate is tangentially transported past the disk so that the rolling contact therebetween substantially centers the planar substrate in the disk thereby avoiding the normal occurring bead of adhesive around the periphery of the disk caused by the spin coating and avoiding the non-uniform portion of the adhesive layer. As the planar substrate moves past and beyond the tangential contact with the adhesive layer on the rotating disk, a uniform portion of the layer of adhesive is peeled from the disk. This mechanized process minimizes operator involvement which is the main source of substrate-to-substrate variation in adhesive layer thickness, and permits adhesive transfer at higher speeds. It also provides more uniform adhesive layers by minimizing time of contact between the substrate and rolling disk and enabling a more constant temperature of the adhesive during the transfer process. The adhesive layer process also allows for an extremely accurate maintenance of the relative orientation of the channel wafer vis-a-vis the disk carrying the adhesive layer further reducing the adhesive layer thickness variation from one wafer to the next.

A more complete understanding of the present invention can be obtained by considering the following detailed description in conjunction with the accompanying drawings, wherein like index numerals indicate like parts.

DESCRIPTION OF THE PREFERRED EMBODIMENT

Figure 1:
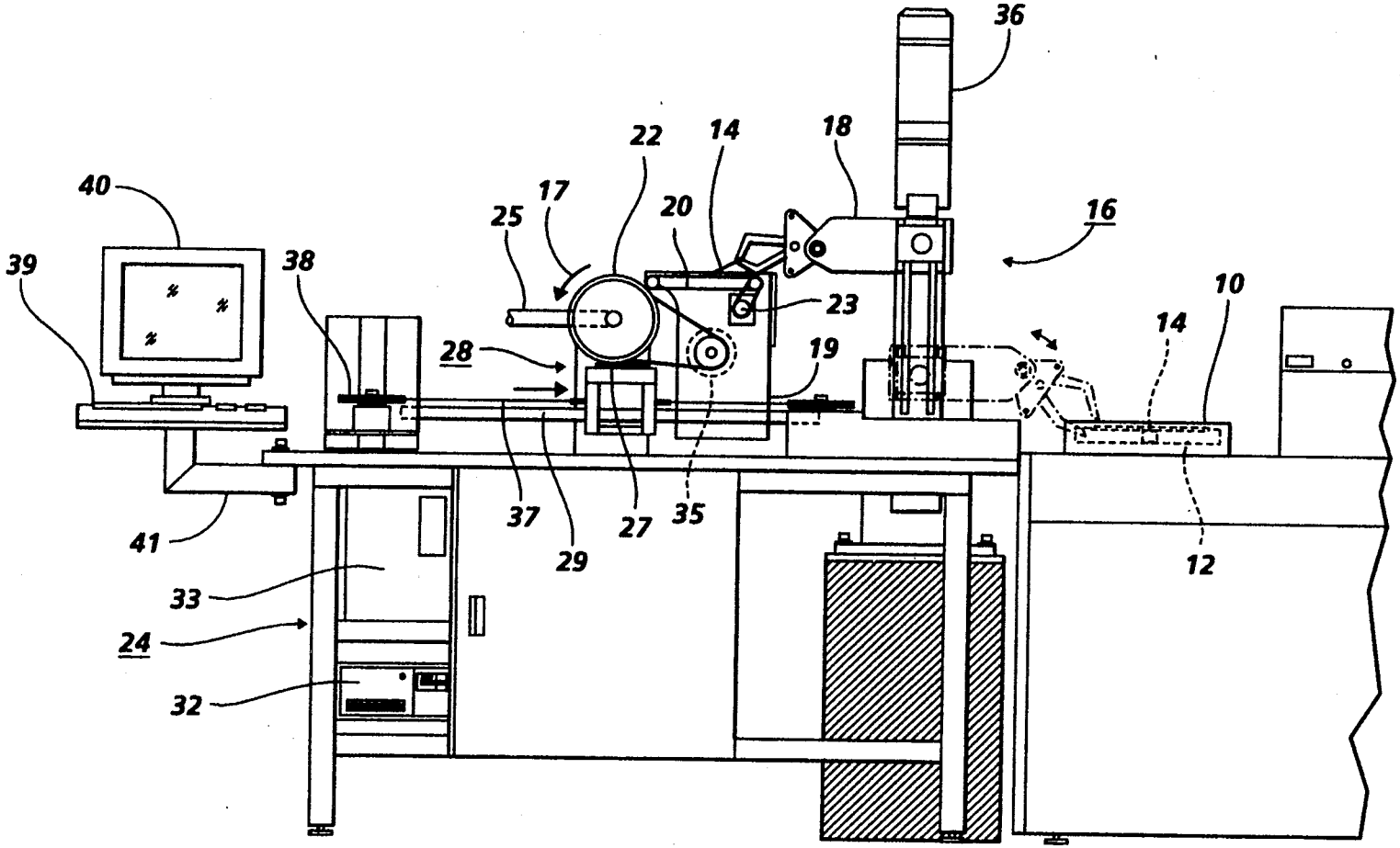
FIG. 1 is a front elevation view of the process line of the present invention.

In FIG. 1, a front elevation of the process equipment for applying a uniform adhesive layer to a planar substrate, such as, an ink jet printhead component, is shown. A typical spinner 10 is modified to provide a flat chuck 12, shown in dashed line, suitable for holding and spinning a five inch diameter, 1 to 5 mil thick disk 14, shown in dashed line, of a polymeric film forming material, such as, for example, Mylar ® film. A thermoplastic thermosetting adhesive (not shown in FIG. 1), such as EPON ® sold by the Shell Chemical Company and disclosed in U.S. Pat. No. 4,678,529, is spin coated on the upper surface of the disk by the spinner. The layer of EPON is spun to a thickness of about 3 μm throughout the disk surface, except at its perimeter, where a thicker bead of EPON normally occurs. To overcome this inherent thickness variation in the adhesive layers at the disk edge, a smaller diameter planar surface, for example, a three and one-half to four inch diameter silicon wafer is used, so that only the uniform area of adhesive is subsequently transferred to the planar substrate. Although any geometrically shaped planar substrate fitting within a circular area having less than a five inch diameter may be used, so as to avoid the thicker circular ring of adhesive on the outer edge of the Mylar film disk, a channel wafer of the type disclosed in U.S. Pat. No. 4,678,529 will be used to illustrate this invention. The disclosure in U.S. Pat. No. 4,678,529 is incorporated herein by reference in its entirety.

After the disk is spin-coated with a layer of EPON® adhesive in the spinner, it is robotically removed therefrom by a program controlled robot 16 through robot arm 18, and placed on conveyor belt 20. Alternatively, the removal of the disk 14 from the spinner and placement thereof on the conveyor belt 20 may be accomplished manually by a human operator. The EPON® adhesive, as disclosed in U.S. Pat. No. 4,678,529, has a state at a predetermined temperature, which in the present invention is 65°±1° C., at which state its molecule-to-molecule adhering forces are weaker than its molecule-to-interface bonding forces, so that the rolling contact of the adhesive on the disk with the coplanar surface on one side of the wafer at about 5 psi causes the layer of adhesive to peel and transfer a uniformly thick layer of 1 to 2 μm from the adhesive layer on the disk to the wafer surfaces.

Figure 2:
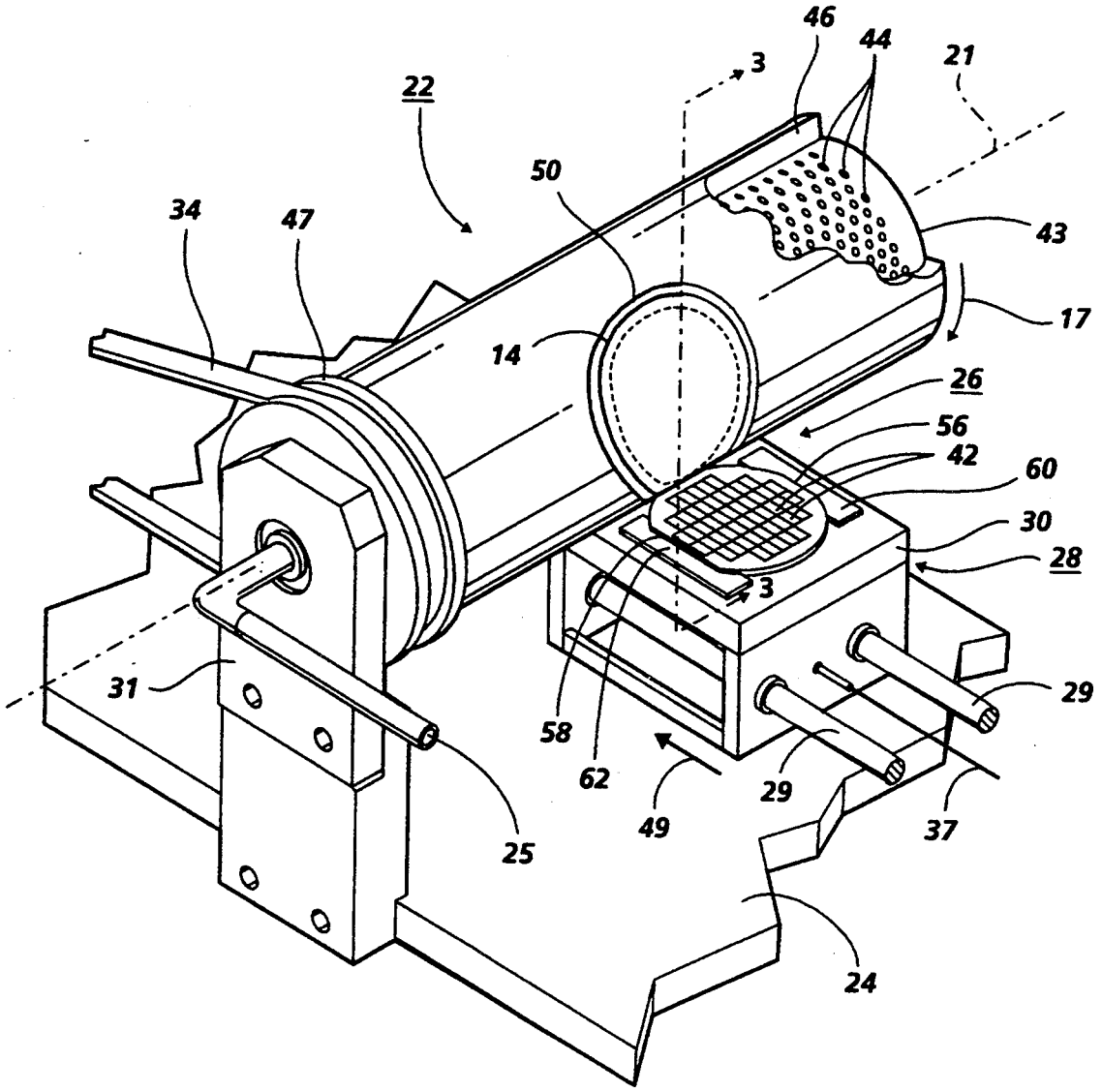
FIG. 2 is partially shown, isometric view of rotating sleeve which vacuum holds the disk with the spin coated adhesive thereon and the transporting means which places a planar substrate into tangential contact with the disk for adhesive layer transfer thereto.

The conveyor belt 20 conveys the disk 14 to a rotating cylindrical, perforated sleeve means 22, described more fully later with reference to FIG. 2. The sleeve means has an axis 21, about which it is rotated by a variable speed motor 35 through gears or timing belt (not shown). The conveyor belt and its drive motor 23 are supported on vertical support member 19 on table 24. The sleeve means is supported by frame member 31 (FIG. 2) and rotatably cantilevered therefrom. It contains an internal cavity to which a vacuum source (not shown) is selectively supplied by conduit 25. The vacuum force in the cavity of the sleeve means holds the disk firmly in position on the outer surface of the sleeve means. When an edge of the disk contacts the sleeve means, the rotation of the sleeve means with the vacuum acting upon the disk through the perforations 44 causes the disk to be wrapped around and held firmly in position on the sleeve means. The disk is rotated by the sleeve means in the direction of arrow 17 through a nip 26 formed by an etched, 3.5 to 4 inch diameter channel wafer 27, containing a plurality of sets of etched channel grooves and associated through-etched reservoirs indicated by rectangles 42 (FIG. 2). The wafer is transported tangentially past the sleeve means by transport means 28. The transport means comprises a carriage 30 (see FIG. 2) mounted on guide rails 29 which is moved in timed registration with the disk 14 on the sleeve means under the control of microprocessor 32 and motion controller 33, mounted under the table 24, through cable 37, pulley 38, and variable speed motor 36. Variable speed motor 35 drives the sleeve means through timing belt 34. A keyboard 39 and display monitor 40 swivelly attached to the table 24 by arm 41 provide the means to input the process speeds of the conveyor and transport means to ensure appropriate registration of the wafer 27 with the disk 14 containing the adhesive layer on the outer surface thereof.

Figure 3:
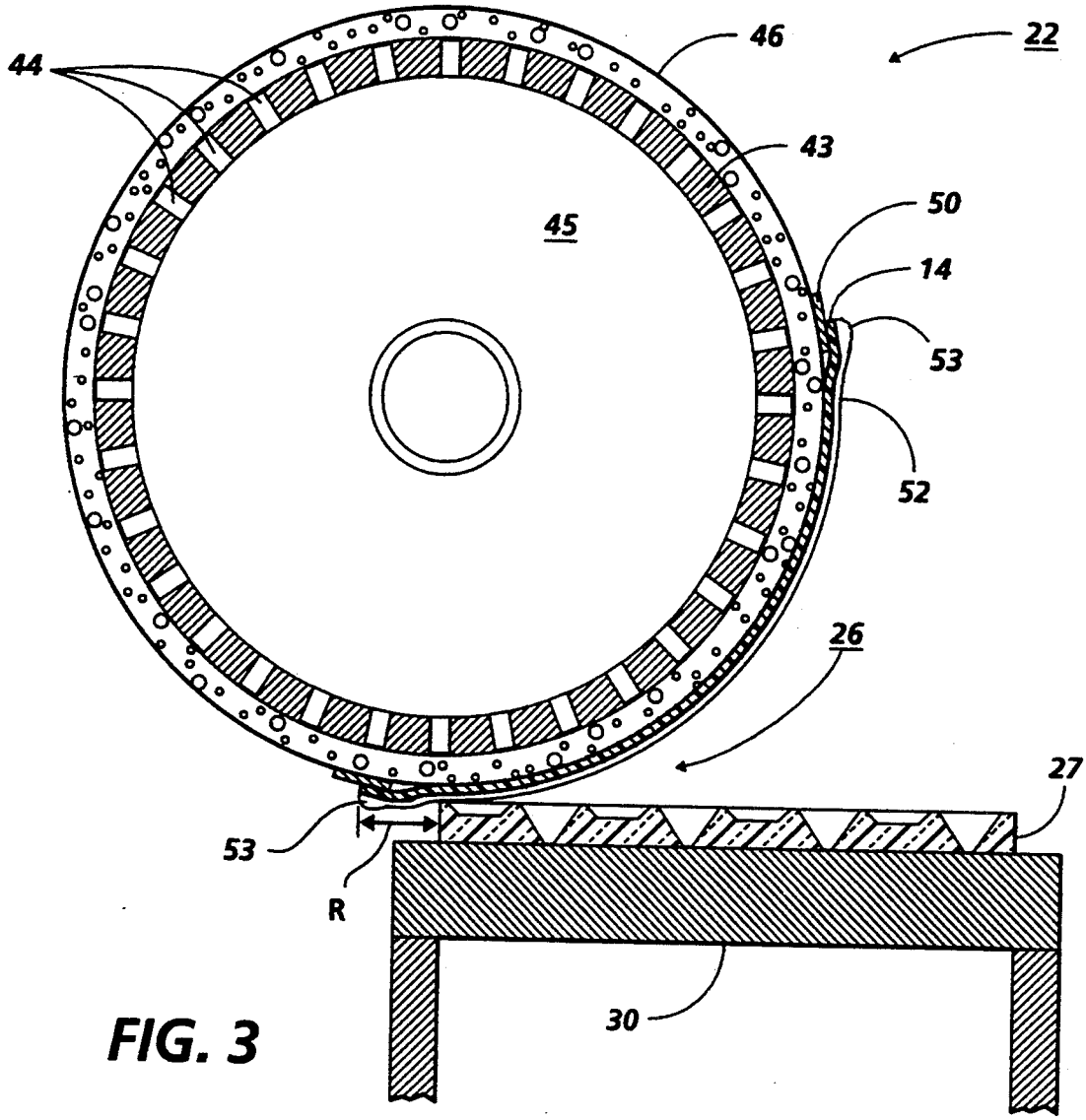
FIG. 3 is a schematic, cross-sectional view of the sleeve and transporting means of FIG. 2 as viewed along view line 3—3.

Referring to FIG. 2, a partially shown, isometric view of the sleeve means 22 and channel wafer transport means 28 shows the aligned registration of the disk 14 and channel wafer 27 at nip 26. The sleeve means comprises an aluminum cylindrical sleeve 43 with closed ends (not shown) to form an internal cavity 45 (FIG. 3). The sleeve has an axis 21 and contains a plurality of holes 44 having a diameter of 10 to 20 mils axially drilled therethrough, covering substantially the entire length of the sleeve. The outer surface of the sleeve is covered by a layer of porous material 46, such as polysulfone foam, having a thickness of 3 to 6 mm. The sleeve is rotatably cantilevered from frame member 31 at one end with an O-ring slip joint to accommodate connection of vacuum conduit 25 thereto, thus permitting sealed relative rotation between the sleeve and the vacuum conduit by drive pulley 47 fixedly mounted on the sleeve at the cantilevered end and timing belt 34 which is driven by variable speed motor 35 (FIG. 1). The transport means 28 comprises carriage 30 for releasably holding an etch channel wafer 27 thereon and guide rails 29 on which the carriage is slidably mounted. The channel wafer has chordal cuts which 9 produce minor and major flats 56, 58, respectively. The carriage has minor and major keyways 60, 62, respectively, which cause receipt of the channel wafer 27 in only one precise orientation. This technique provides the means for extremely accurate maintenance of the relative orientation of the channel wafer 27 vis-a-vis the disk 14 carrying the adhesive further reducing the adhesive layer thickness variation from one wafer to the next. Variable motor 36 controls the speed of the carriage as it moves towards the sleeve in the direction of arrow 49 by cable 37 to assure timed registration with the adhesive layer containing disk 14 firmly held in a predetermined location on the layer of porous material 46 by the vacuum in the sleeve cavity acting through the drilled holes or perforations and the porous layer. The porous material or foam provides a compliant surface for the channel wafer to insure that the transfer of adhesive from the disk to the channel wafer during the rolling contact of the disk is uniform and that the wafer is not broken or damaged by the pressure generated at the nip. The tangential contact between the wafer and the disk produces a pressure of about 5 psi, easily adjusted by adjustment of the separation between the roller and the carriage. Heating elements and temperature sensors (neither shown) are formed on the carriage surface carrying the wafer to maintain the wafer at a temperature of 65°±1° C. under the control of the microprocessor and motion controller, so that a uniform thickness of 1 to 2 μm of adhesive is transferred from the disk to the coplanar surfaces of the wafer 27 by the rolling contact of the adhesive layer containing disk at the nip 26. The disk with the adhesive layer facing away from the sleeve is rotated one revolution while it is being held in a predetermined position, so that the disk moves through the nip 26 in timed registration with the wafer or planar substrate. This is followed by a vacuum shut off and a slight air pressure is applied to the sleeve cavity to release the used disk. When released the disk falls into a waste bin (not shown) placed underneath the sleeve and carriage guide rails.

Optionally, an annular ring 50 of polymeric film forming material, such as Teflon®, having an outer diameter of 5.5 inches and an inner diameter of 4.5 inches and a thickness of 50 to 150 μm is adhered to the layer of porous material at the desired location for placement of the disk, so that any adhesive inadvertently spread beyond the edge of the disk during the transfer to the smaller diameter wafer 27 is captured on the Teflon® ring to allow the adhesive to be readily cleaned therefrom without the adhesive building up on the layer of porous material and necessitating its early replacement.

Figure 4:
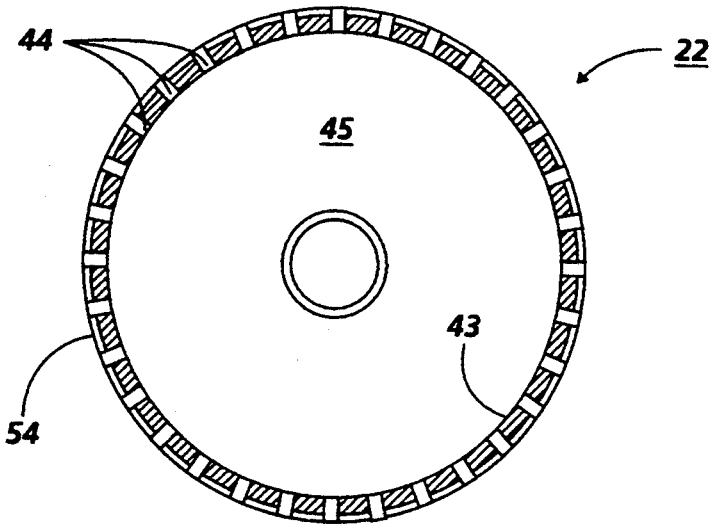
FIG. 4 is a cross-sectional view of an alternate embodiment of the sleeve in FIG. 3.

FIG. 3 is a cross-sectional view of the sleeve means 22 as viewed along view line 3—3 in FIG. 2. This view shows the thicker bead 53 of adhesive normally produced at the outer periphery of the disk 14 by the spin coating action in the spinner. By centering the smaller diameter etched channel wafer 27 relative to the larger diameter adhesive bearing disk 14, a more uniform layer 52 of adhesive is applied to the coplanar surface areas on the surface of the wafer. This centering of the wafer with the disk is represented by the radial distance "R" between the edges of the respective members. FIG. 4 is an alternate embodiment of the sleeve in FIG. 3. The only difference is that a relative thin resilient layer 54 having a thickness of1 to 2 μm is substituted for the foam layer 46, such as, neoprene or the like. Layer 54 is formed on the sleeve prior to drilling the holes in the sleeve, and then holes are drilled through both the sleeve and the neoprene layer, so that the vacuum in the sleeve cavity 45 acts upon and holds the disk to the resilient neoprene layer on the sleeve through the holes 44.

In summary, this invention improves the thickness variation tolerance of the EPON®, an adhesive manufactured by the Shell Chemical Corporation and adhesive of choice for bonding channel wafers to heater wafers in the fabrication of thermal ink jet printheads, as disclosed in U.S. Pat. No. 4,678,529 and incorporated herein by reference. When EPON® is spin coated onto a two to five mil thick Mylar® disk by a typical commercial spinner, there are thickness variations caused by the ribs in the vacuum chuck which holds the disks to be coated. An improvement is obtained by replacing the ribbed vacuum chuck provided with the commercial spinner with a smooth surface custom made chuck to prevent the undulations in the spin coated layer of adhesive. Next, it was recognized that a thicker ring of adhesive was always produced at the outer of the Mylar® disk, so that by increasing its diameter and subsequently using only the uniformly thick center portion of the adhesive layer, additional tolerance control on the thickness of the spin coated adhesive layer is obtained. However, EPON® flows more freely during its curing cycle than was originally anticipated, which continued to cause ink channel restrictions and clogs to varying degrees, depending upon the amount of uncured EPON® at any one location. Manual application of the disks with the EPON® to the channel wafers and the subsequent manual smoothing of the disk over the coplanar lands of the etched wafer surface introduced adhesive thickness variations in the transferred layer of adhesive due to the non-uniform treatment inherently produced by the human operator. The inability to maintain the same pressure and angle during the process of transfer of the adhesive from the Mylar® disk to the channel wafer are the main reasons for the observed variations in the thickness of the transferred layer of EPON® adhesive. In addition, it is hard to maintain the vary same roller strokes and stroke directions during such transfer.

Accordingly, a more mechanized process to place the adhesive coating on the disk with the channel wafer was required to minimize operator involvement and consequent variation in parameters which introduced thickness variations in the amount of adhesive layer transferred to the channel wafers, especially in the thickness variations from wafer-to-wafer. This was accomplished by a perforated rotating sleeve with a resilient, porous layer through which a vacuum was applied to attach and hold the disks. A transport means, including a carriage for holding the channel wafers, tangentially moved the wafers into timed registration with the revolving disk so that a nip was formed whereat the adhesive layer was rolled onto the surface of the wafer. The carriage heated the wafer to the desired temperature and provided the desired contact pressure between the disk and wafer. After the entire wafer had passed by the nip or transfer zone the vacuum in the sleeve was removed, allowing the disk to fall from the sleeve into a waste bin underneath the sleeve. Upon re-application of the vacuum to the sleeve, another disk with the adhesive coating is brought by conveyor belt to the sleeve and at the desired location, whereupon another wafer is placed on the carriage and transported into the nip. This process and apparatus permit very close tolerance control to the adhesive layer transferred to the channel wafer surfaces.

Many modifications and variations are apparent from the foregoing description of the invention and all such modifications and variations are intended to be within the scope of the present invention.

We claim:

1. Apparatus for uniformly coating a planar substrate with an adhesive layer, comprising:

(a) a rotatably mounted sleeve having an axis, a cylindrical outer surface, and closed ends which form an internal cavity in the sleeve, the sleeve having a plurality of holes therein which penetrate the sleeve outer surface in a direction perpendicular to the sleeve axis;

(b) a porous layer of foam being formed on the sleeve outer surface;

(c) means for rotating the sleeve about the sleeve axis at a predetermined angular velocity;

(d) means for applying a vacuum to the sleeve cavity from a vacuum source, while the sleeve is being rotated by said rotating means;

(e) a flexible sheet of polymeric film forming material having a predetermined shape and two opposing surfaces, one surface of the flexible sheet being positioned against the porous layer of foam on the sleeve and firmly held in place thereon by the vacuum in the sleeve cavity acting through the sleeve holes and porous layer of foam, the other surface of the flexible sheet having a uniform adhesive coating thereon of predetermined thickness; and (f) means for transporting a planar substrate having a surface with recesses therein tangentially past the flexible sheet at a predetermined speed, the transporting means having heater means to heat the planar substrate to a predetermined temperature and concurrently moving the planar substrate into timed registration with the surface of the flexible sheet having the adhesive coating as said flexible sheet is rotated by the sleeve about the sleeve axis, thereby forming a nip between the planar substrate and the flexible sheet, the transporting means coacting with the porous layer of foam on the sleeve to apply a predetermined pressure between the flexible sheet and planar substrate, so that a consistently uniform thickness of the layer of adhesive is transferred to a plurality of the planar substrates one at a time.

2. The apparatus of claim 1, wherein the porous foam layer has a thickness of 3 to 6 mm.

3. The apparatus of claim 2, wherein the porous foam layer is a polysulphone foam.

4. The apparatus of claim 1, wherein the flexible sheet is a Mylar film disk having a thickness of 100 to 150 μm and a diameter of 5 inches or 12.7 cm, and wherein the adhesive thickness on the film disk is about 3 μm.

5. The apparatus of claim 4, wherein the planar substrate is a silicon wafer having a diameter of 3.5 to 4 inches or 8.9 to 10.2 cm.

6. The apparatus of claim 5, wherein the wafer is 20 mils or 500 μm thick.

7. The apparatus of claim 4, wherein the predetermined temperature of the wafer is 65°±1 ° C., wherein the predetermined pressure between the film disk and wafer is about 5 pounds per square inch (psi), and wherein the uniform transferred thickness of adhesive is 1 to 2 μm.

8. The apparatus of claim 4, wherein a flat annular ring of polymeric film forming material having an outer diameter larger and an inner diameter smaller than the film disk and having a thickness of 100 to 150 μm is attached to the porous layer on the sleeve at a predetermined location on which the film disk is to be positioned, so that the outer edge of the film disk resides on said annular ring and receives any adhesive that may inadvertently spread from the film disk, thereby preventing the adhesive from contaminating the porous layer of foam and providing a surface that may be readily cleaned.

9. The apparatus of claim 8, wherein the planar substrate has a diameter less than the inner diameter of the annular ring, so that only the center portion of the adhesive layer on the film disk is placed in contact with the planar substrate surface when the means for transporting the planar substrate moves the planar substrate tangentially past and in timed registration with the film disc surface having the adhesive layer thereon.

10. Apparatus for uniformly coating a planar substrate with an adhesive layer, comprising:

(a) a rotatably mounted sleeve having an axis, a cylindrical outer surface, and closed ends which form an internal cavity in the sleeve, the sleeve having a plurality of holes therein which penetrate the sleeve outer surface in a direction perpendicular to the sleeve axis;

(b) a porous layer being formed on the sleeve outer surface, wherein the porous layer is a neoprene layer having holes therein in alignment with the holes in the sleeve and has a thickness of 1 to 2 mm.

(c) means for rotating the sleeve about the sleeve axis at a predetermined angular velocity;

(d) means for applying a vacuum to the sleeve cavity from a vacuum source, while the sleeve is being rotated by said rotating means;

(e) a flexible sheet of polymeric film forming material having a predetermined shape and two opposing surfaces, one surface of the flexible sheet being positioned against the porous neoprene layer on the sleeve and firmly held in place thereon by the vacuum in the sleeve cavity acting through the sleeve holes and porous neoprene layer, the other surface of the flexible sheet having a uniform adhesive coating thereon of predetermined thickness; and (f) means for transporting a planar substrate having a surface with recesses therein tangentially past the flexible sheet at a predetermined speed, the transporting means having heater means to heat the planar substrate to a predetermined temperature and concurrently moving the planar substrate into timed registration with the surface of the flexible sheet having the adhesive coating as said flexible sheet is rotated by the sleeve about the sleeve axis, thereby forming a nip between the planar substrate and the flexible sheet, the transporting means coacting with the porous neoprene layer on the sleeve to apply a predetermined pressure between the flexible sheet and planar substrate, so that a consistently uniform thickness of the layer of adhesive is transferred to a plurality of the planar substrates one at a time.

* * * * *